US007198092B2

(12) United States Patent
Hauri et al.

(10) Patent No.: US 7,198,092 B2
(45) **Date of Patent: *Apr. 3, 2007**

(54) CHILL TUBE

(75) Inventors: Roland Hauri, Wettswil (CH); Raimund Eichholz-Boldt, Osnabrück (DE); Dietmar Kolbeck, Steinfeld (DE); Gerhard Hugenschütt, Belm (DE)

(73) Assignee: KM Europa Metal Aktiengesellschaft (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/931,766

(22) Filed: Sep. 1, 2004

(65) Prior Publication Data

US 2005/0028960 A1 Feb. 10, 2005

Related U.S. Application Data

(63) Continuation of application No. 10/342,559, filed on Jan. 15, 2003.

(30) Foreign Application Priority Data

Jan. 31, 2002 (DE) ..... 102 03 967

(51) Int. Cl.
*B22D 11/00* (2006.01)
*B22D 11/124* (2006.01)

(52) U.S. Cl. ..... 164/418; 164/443

(58) Field of Classification Search ..... 164/418, 164/459, 443
See application file for complete search history.

(56) References Cited

U.S. PATENT DOCUMENTS

| | | | | |
|---|---|---|---|---|
| 6,443,218 | B1 | 9/2002 | Hornschemeyer | |
| 6,612,363 | B1 | 9/2003 | Lorento | |
| 6,736,202 | B2 * | 5/2004 | Hauri et al. | 165/166 |
| 6,827,127 | B2 * | 12/2004 | Hauri | 164/459 |
| 6,942,012 | B2 * | 9/2005 | Hauri et al. | 164/418 |

* cited by examiner

*Primary Examiner*—Kuang Y. Lin
(74) *Attorney, Agent, or Firm*—Kenyon & Kenyon LLP

(57) ABSTRACT

A chill tube (1) having a double T-shaped inner and outer cross section in beam blank format is encased in a water-guiding jacket (12) adapted to its outer contour while forming a water gap (14). The wall thickness (D) of chill tube (1) in the rounded transition regions (2) from middle crosspieces (4), which face each other head to head and are drawn in towards longitudinal axis (3), to the neighboring crosswise positioned flanges (5) is dimensioned at least partially smaller than in the remaining wall sections (6, 7). The reduction in wall thickness is implemented by longitudinal hollow recesses (8). These recesses (8) extend only in the height range of the bath level. Into the cross sectional regions which are formed by the outer contour of chill tube (1) as well as the inner contour of water-guiding jacket (12), filler pieces (17) are incorporated, adapted to this cross section.

8 Claims, 2 Drawing Sheets

CHILL TUBE

RELATED APPLICATION

This application is a continuation of U.S. patent application Ser. No. 10/342,559, filed Jan. 15, 2003, which claims foreign priority benefits under 35 U.S.C. § 119 of German Patent Application No. 102 03 967.4, filed Jan. 31, 2002.

BACKGROUND OF THE INVENTION

1. Field of the Invention

The invention relates to a mold/chill tube having a double T-shaped inner and outer cross section in beam blank format which is encased in a water-guiding jacket adapted to its outer contour while forming a water gap.

2. Description of Related Art

In the continuous casting of metals using a chill tube, the material temperatures in the chill wall result from the heat stresses occurring during continuous casting and the cooling conditions by the respective medium, which normally, in the form of water, flows from bottom to top in a water gap between a water-guiding jacket fitted to the outer contour of the chill tube and the outer surface of the chill tube, thereby taking up the heat encountered and carrying it off. The removal of the heat with the aid of the cooling water is largely determined by the speed of the water in the water gap.

In the continuous casting of metals using a chill tube of the type in question here, it has been observed that, because of the special geometry of the beam blank format, extreme local heat stresses occur in the transition regions from middle crosspieces, which face one another head to head and are drawn in in the direction towards the longitudinal axis, and the bordering flanges which are positioned at an angle. In the case of unfavorable geometrical relationships of the transition regions, these local heat stresses lead to overheating of the chill tube, and, as a result, to a drastic reduction in its service life.

SUMMARY OF THE INVENTION

It is an object of the invention to develop a mold/chill tube having a double T-shaped inner and outer cross section in beam blank format for the continuous casting of metals, in which local overheating of the transitional regions is avoided, and thereby a longer service life is achieved.

These and other objects of the invention are achieved by a chill tube having a double T-shaped inner and outer cross section in beam blank format, which is encased in a water-guiding jacket (12) adapted to its outer contour while forming a water gap (14), wherein the wall thickness (D) of chill tube (1) in the rounded transition regions (2, 2*a*, 2*b*, 2*c*, 2*d*) from middle crosspieces (4), which face each other head to head and are drawn in towards longitudinal axis (3), to the neighboring crosswise positioned flanges (5) is dimensioned at least partially smaller than in the remaining wall sections (6, 7).

BRIEF DESCRIPTION OF THE DRAWINGS

The invention will be described in greater detail with reference to the following drawings wherein.

DETAILED DESCRIPTION OF THE INVENTION

On account of the at least partial reduction of the wall thickness of the chill tube in the rounded transition regions, a clearly improved heat removal is achieved, so that a local overheating of the transition regions is avoided, and as a result, the service life of the chill tube is clearly increased.

With respect to the fact that, in the continuous casting of metals, the highest heat stress in the chill tube occurs, as a rule, at the height range of the bath level, it is provided that the wall thickness in the transition regions is reduced only at the height range of the bath level.

The reduction of the wall thickness of the chill tube in the rounded transition regions can be carried out in various ways.

One option is that at the outside of the transition regions longitudinal hollow recesses are provided. The curvature of the recesses, in this case, may be largely adapted to the curvature of the inner surface of the transition regions. In addition, the reduction in wall thickness, in the form of a hollow recess, has the advantage that the outer surface of the chill tube is enlarged, so that an even better cooling effect may be achieved.

Another possibility of wall thickness reduction is that on the outside of the transition regions, a plurality of longitudinal grooves running side by side are provided. The cross section and/or depth of the grooves may be dimensioned to be equal or different in each transition region. The cross section of the grooves may be rounded or angular, such as triangular.

Furthermore, for the reduction in wall thickness in the wall sections of the transition regions, it is also possible to provide a plurality of longitudinal bores running next to one another. The size of the bores, their number, their distance apart, and also their position in relation to the outside or the inside contour of the chill tube may vary. However, it is advantageous if the bores are closer to the outer surface than to the inner surface of the chill tube.

Since heat removal using cooling water is determined, as is known, by the speed of the water in the water gap between the chill tube and the water-guiding jacket, this water gap should be maintained even in the region of the wall thickness reduction, in order to guarantee uniform water speed in the entire water gap. This being the case, in a specific embodiment, it is provided that the water-guiding jacket has a rectangular cross section, and, between the water-guiding jacket as well as the crosspieces and the flanges, filler pieces adjusted to the cross sectional region by the outer contour of the chill tube as well as the inner contour of the water-guiding jacket are incorporated.

Figure 2:
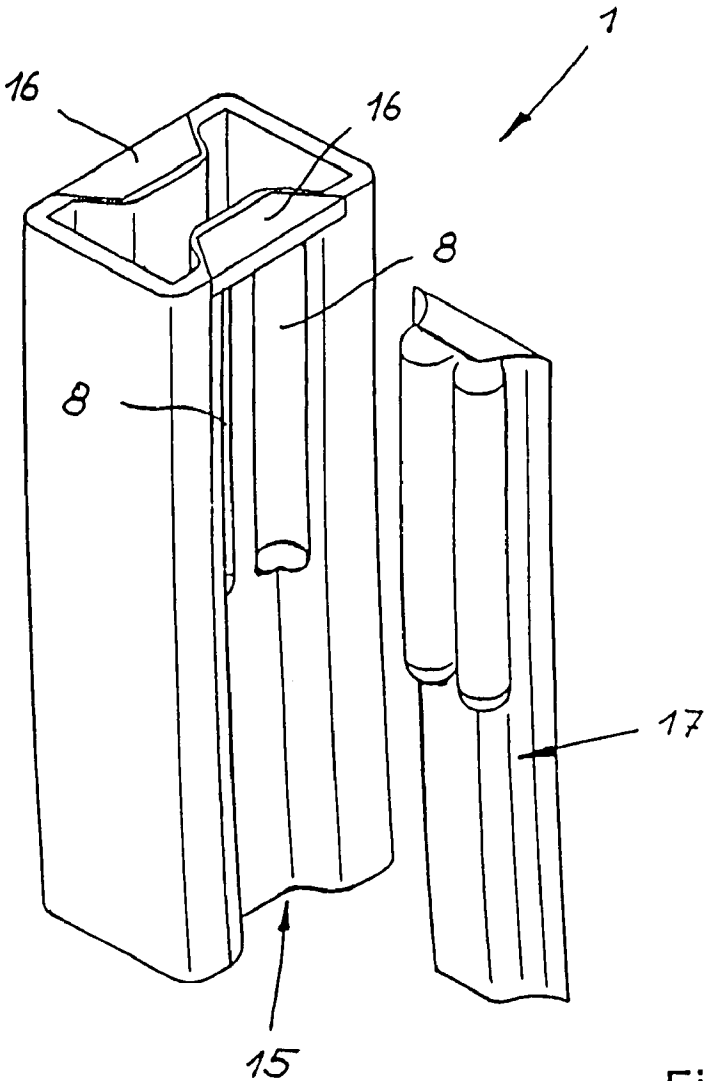
FIG. 2 shows likewise in schematic perspective, the chill tube of FIG. 1 along with a separately shown filler piece.
Figure 3:
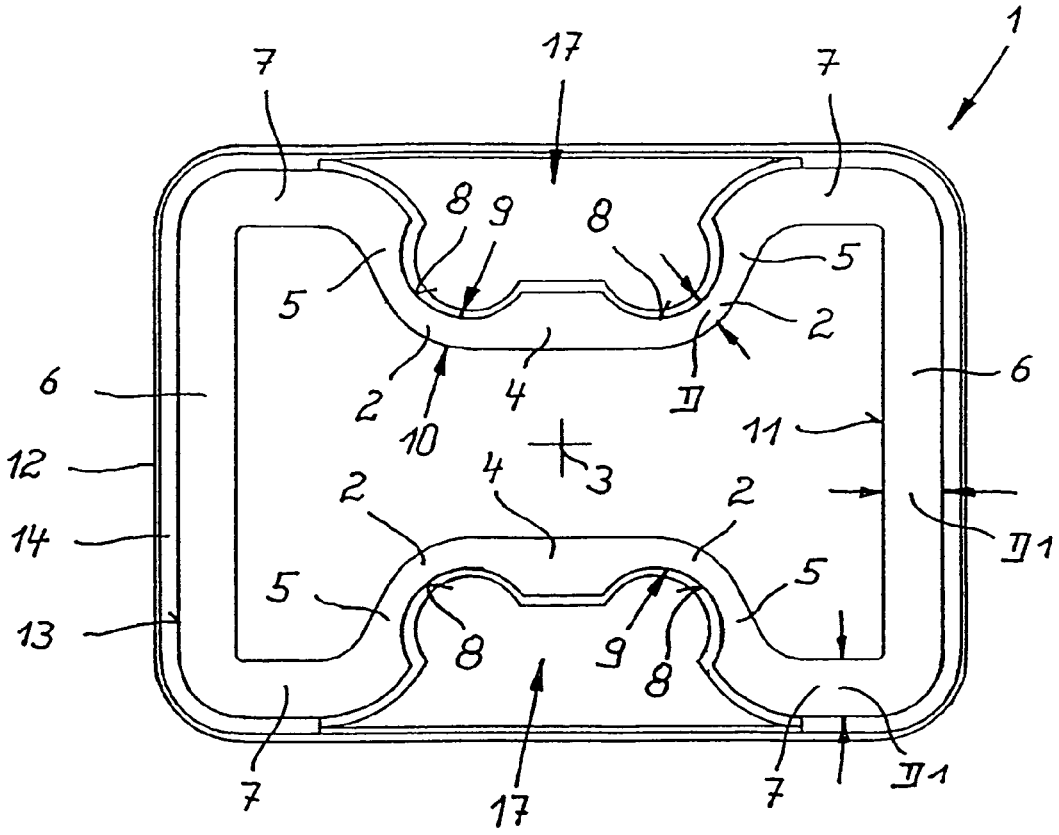
FIG. 3 shows a top view of a chill tube without cover plate in the region of the lateral channels, but having a water-guiding jacket.
Figure 4:
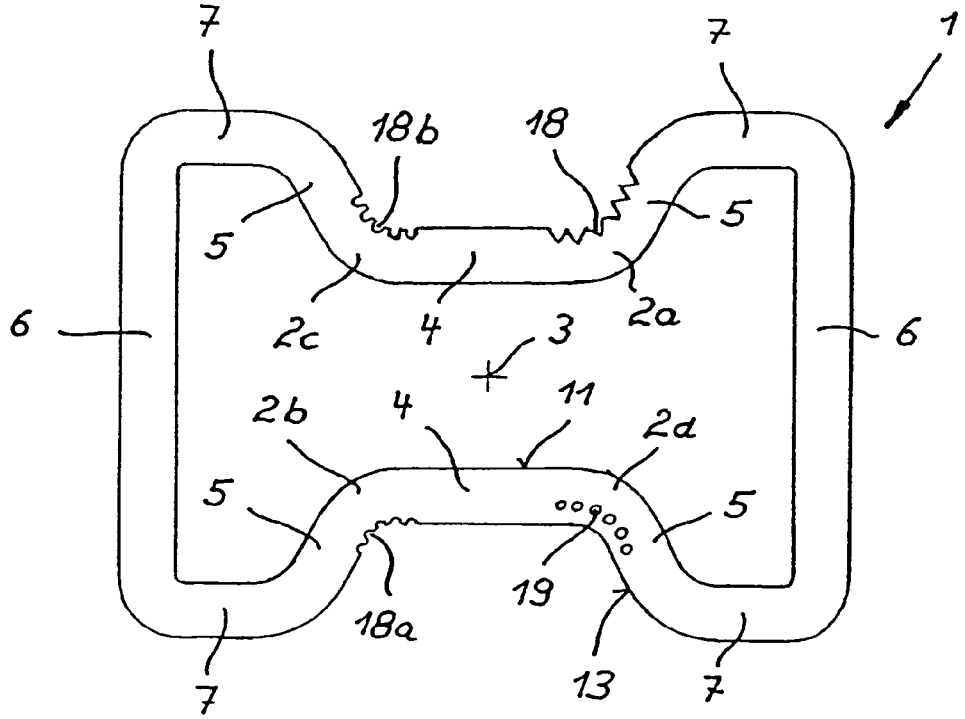
FIG. 4 shows a top view onto a chill tube according to further specific embodiments without cover plate and water-guiding jacket.

The numeral 1 in FIGS. 1 through 4 denotes a chill tube having a double T-shaped inner and outer cross section in beam blank format. Chill tube 1 is used for the continuous casting of metals. In FIGS. 3 and 4, the curvature of chill tube 1 in the longitudinal direction is not shown.

As may be seen in greater detail in FIG. 3, wall thickness D of chill tube 1 in rounded transition regions 2 from middle crosspieces 4, which face each other head to head and are drawn in towards longitudinal axis 3, to the neighboring, crosswise positioned flanges 5 is dimensioned less than wall thickness D1 in the remainder of wall sections 6 and 7.

Figure 1:
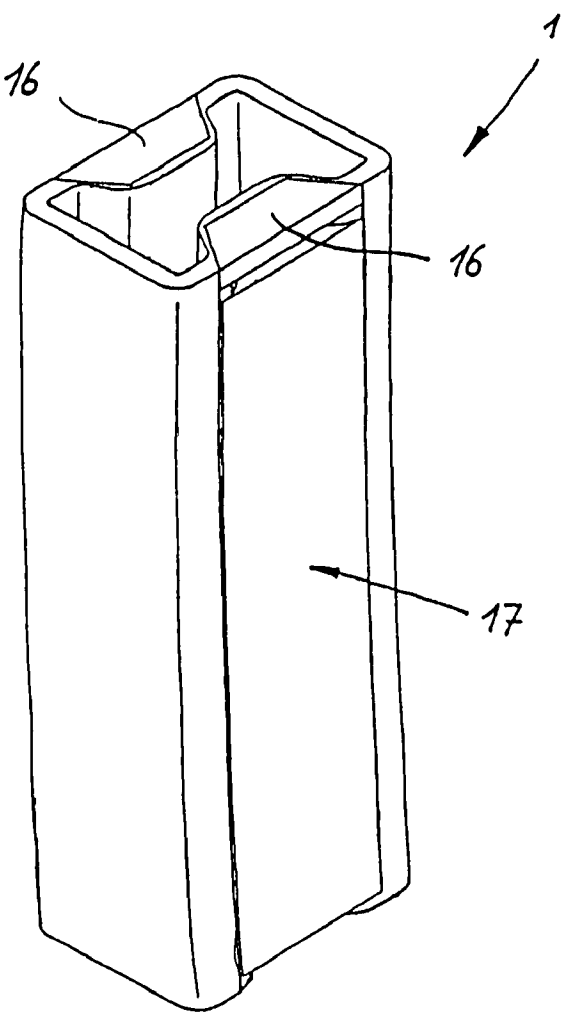
FIG. 1 shows in schematic perspective, a chill tube in beam blank format without a water-guiding jacket having lateral filler pieces.

The reduction in wall thickness takes place in the specific embodiment of FIGS. 1 through 3 in that, on the outside of transition regions 2, longitudinal hollow recesses 8 are provided. These recesses 8 extend, as may be seen in FIG. 2, only as far as the height range of the bath level which is not shown in detail. Curvature 9 of recesses 8 is largely adjusted to curvature 10 of inner surface 11 of chill tube 1 in transition ranges 2.

On the peripheral side of chill tube 1 there is a water-guiding jacket 12 which may be seen only in FIG. 3, having an essentially rectangular cross section. Between water-guiding jacket 12 and outer surface 13 of chill tube 1, a water gap 14 is formed through which cooling water is guided from bottom to top at a predefined water speed.

In order to achieve uniform water speed in water gap 14, even in lateral channels 15 of chill tube 1, which, according to FIGS. 1 and 2 are closed off at their upper end by cover plate 16 in water gap 14, these channels are provided with filler pieces 17, which, in the upper region are also adapted to hollow recesses 8.

FIG. 4 shows four different specific embodiments of how the reduction in wall thickness of chill tube 1 may also be implemented.

In transition regions 2*a*, 2*b*, 2*c*, on the outer side, several longitudinal grooves 18, 18*a*, 18*b* are provided which run next to one another. Whereas in transition region 2*a* grooves 18 have a triangular cross section, grooves 18*a*, 18*b* in transition regions 2*b*, 2*c* have rounded bottoms. In this context, grooves 18*b* in transition region 2*c* have a greater depth than grooves 18*a* in transition region 2*b*.

In transition region 2*d*, reduction in wall thickness is implemented by bores 19. These bores 19 lie closer to outer surface 13 of chill tube 1 than to inner surface 11.

Both grooves 18, 18*a*, 18*b* and bores 19 extend, as do recesses 8, only in the height range of the bath level.

What is claimed is:

1. A chill tube comprising:

a beam blank format having a double T-shaped inner and outer cross section, said beam blank format encased in a jacket adapted to an outer contour of the beam blank, a gap lying between the outer contour and the jacket, wherein a wall of the beam blank format in rounded transition regions between middle crosspieces, which face each other head to head and are drawn in towards a longitudinal axis of the chill tube, and neighboring crosswise positioned flanges comprises a plurality of longitudinal grooves which run next to one another on the outer contour of the beam blank format in the rounded transition regions.

2. The chill tube of claim 1, wherein the beam blank format includes grooves in the transition regions only in a height range of a bath level.

3. The chill tube of claim 1, wherein the grooves have at least one of a V-shape and U-shape.

4. The chill tube according to claim 1, wherein the jacket has an essentially rectangular cross section, and, between the jacket as well as the crosspieces and the flanges, filler pieces adapted to the cross sectional region by the outer contour of the chill tube as well as the inner contour of the jacket are incorporated.

5. A chill tube comprising:

a beam blank format having a double T-shaped inner and outer cross section, said beam blank format encased in a jacket adapted to an outer contour of the beam blank, a gap lying between the outer contour and the jacket, wherein a wall of the beam blank format in rounded transition regions between middle crosspieces, which face each other head to head and are drawn in towards a longitudinal axis of the chill tube, and neighboring crosswise positioned flanges comprises a plurality of longitudinal bores which run next to one another between the outer contour and an inner contour of the beam blank.

6. The chill tube of claim 5, wherein the beam blank format includes bores in the transition regions only in a height range of a bath level.

7. The chill tube of claim 5, wherein the bores are closer to the outer counter of the beam blank format than to the inner counter of the beam blank format.

8. The chill tube according to claim 5, wherein the jacket has an essentially rectangular cross section, and, between the jacket as well as the crosspieces and the flanges, filler pieces adapted to the cross sectional region by the outer contour of the chill tube as well as the inner contour of the jacket are incorporated.

* * * * *